US011814777B2

(12) United States Patent
Arankalle et al.

(10) Patent No.: US 11,814,777 B2
(45) Date of Patent: Nov. 14, 2023

(54) HINGE SYSTEM FOR TOUCHLESS COMMERCIAL APPLIANCES

(71) Applicant: WHIRLPOOL CORPORATION, Benton Harbor, MI (US)

(72) Inventors: Mayuresh P. Arankalle, Pune (IN); Mohsin M. Attar, Kolhapur (IN); Ameya S. Kshirsagar, Pune (IN); Sagar Kumar, Beawar (IN); Vivek Mansing Patil, Sangli (IN); Manish Saha, Pune (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 292 days.

(21) Appl. No.: 17/208,741

(22) Filed: Mar. 22, 2021

(65) Prior Publication Data

US 2022/0298713 A1 Sep. 22, 2022

(51) Int. Cl.

| | |
|---|---|
| ***D06F 39/14*** | (2006.01) |
| ***E05F 3/12*** | (2006.01) |
| ***E05F 3/20*** | (2006.01) |
| ***E05F 3/22*** | (2006.01) |

(52) U.S. Cl.

CPC ..... *D06F 39/14* (2013.01); *E05F 3/12* (2013.01); *E05F 3/20* (2013.01); *E05F 3/224* (2013.01); *E05Y 2900/312* (2013.01)

(58) Field of Classification Search

CPC .... D06F 39/14; E05F 3/12; E05F 3/20; E05F 3/224; E05Y 2900/312

See application file for complete search history.

(56) References Cited

U.S. PATENT DOCUMENTS

| | | | | |
|---|---|---|---|---|
| 5,546,773 | A * | 8/1996 | Lee | D06F 39/14 160/188 |
| 5,724,837 | A * | 3/1998 | Shin | D06F 37/28 160/188 |
| 8,217,611 | B2 * | 7/2012 | Ennis | G10L 15/26 318/135 |
| 9,273,425 | B2 * | 3/2016 | Kim | D06F 39/14 |
| 10,260,269 | B2 | 4/2019 | Weißenburger | |
| 10,585,407 | B2 | 3/2020 | Bodine et al. | |
| 10,597,807 | B2 | 3/2020 | Jiang et al. | |
| 2006/0086154 | A1 * | 4/2006 | Kim | D06F 39/14 68/24 |
| 2011/0139772 | A1 * | 6/2011 | Darney | H05B 6/6414 292/201 |

(Continued)

FOREIGN PATENT DOCUMENTS

| | | | |
|---|---|---|---|
| CH | 381184 | A | 8/1964 |
| CN | 204138956 | U | 2/2015 |

(Continued)

*Primary Examiner* — Daniel J Rohrhoff

(74) *Attorney, Agent, or Firm* — Brooks Kushman, P.C.

(57) ABSTRACT

A contactless laundry treating apparatus may include a cabinet having a front panel defining an access opening configured to receive laundry items, door attached to the front panel via a hinge assembly, where the hinge assembly may include a hydraulic system arranged on an interior of the front panel within the cabinet configured to engage with a connecting hook arranged within the door to selectively apply an outward force on the connecting hook to open the door and an inward force on the connecting hook to close the door.

12 Claims, 5 Drawing Sheets

(56) References Cited

U.S. PATENT DOCUMENTS

| | | | | |
|---|---|---|---|---|
| 2017/0248926 | A1* | 8/2017 | Bodine | G05B 19/182 |
| 2019/0249349 | A1* | 8/2019 | Han | E05F 3/20 |
| 2019/0292705 | A1 | 9/2019 | Boutiette | |
| 2021/0010190 | A1* | 1/2021 | Ahamad | D06F 39/14 |

FOREIGN PATENT DOCUMENTS

| | | | |
|---|---|---|---|
| CN | 105096580 | A | 11/2015 |
| CN | 106120242 | A | 11/2016 |
| CN | 106381647 | A | 2/2017 |
| CN | 107653646 | A | 2/2018 |
| CN | 107700163 | A | 2/2018 |
| CN | 108570804 | A | 9/2018 |
| CN | 110379091 | A | 10/2019 |
| CN | 106149301 | B | 5/2020 |
| DE | 102014207737 | A1 | 11/2015 |
| DE | 202017103995 | U1 | 10/2018 |
| DE | 102017213673 | A1 | 2/2019 |
| DE | 202020104182 | U1 | 7/2020 |
| EP | 0477926 | A1 | 4/1992 |
| EP | 2824231 | A1 | 1/2015 |
| EP | 2931957 | B1 | 8/2017 |
| JP | 2018510034 | A | 4/2018 |
| WO | 2016155592 | A1 | 10/2016 |

* cited by examiner

HINGE SYSTEM FOR TOUCHLESS COMMERCIAL APPLIANCES

TECHNICAL FIELD

Described herein are hinge systems for touchless commercial appliances.

BACKGROUND

Commercial appliances, including commercial laundry appliances such as clothes washers and dryers, typically include a cabinet having a front panel with an access opening accessible via an appliance door. The door is pivotably mounted to the cabinet and may typically be opened and closed by a customer using a handle on the door. However, the desire for more contactless operation of commercial appliance is desired.

SUMMARY

A contactless laundry treating apparatus may include a cabinet having a front panel defining an access opening configured to receive laundry items, door attached to the front panel via a hinge assembly, where the hinge assembly may include a hydraulic system arranged on an interior of the front panel within the cabinet configured to engage with a connecting hook arranged within the door to selectively apply an outward force on the connecting hook to open the door and an inward force on the connecting hook to close the door.

A door assembly for a commercial laundry treating apparatus may include a door attached to a front panel of an appliance via a hinge assembly to allow selective access to an interior of the appliance; and a connecting hook arranged on the door at the hinge assembly, the hinge assembly including a hydraulic system at least partially arranged on an interior of the front panel, the hydraulic system including a hydraulically driven piston attached to the hook, the piston configured to selectively apply an outward force on the connecting hook to open the door and an inward force on the connecting hook to close the door.

A method for automating interaction with high contact appliance areas may include applying an outward force on a connecting hook to open a door to a treatment chamber of an appliance, by pumping liquid from a first side of a piston to a second side of the piston, thereby extending a rod connecting the piston to the connecting hook outward from the appliance, and applying an inward force on the connecting hook to close the door to the treatment chamber of the appliance by pumping the liquid from the second side of the piston to the first side of the piston, thereby retracting the rod inward into the appliance.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As users desire to have less contact with public surfaces, the need for contactless commercial appliances has increased. In a specific example, users may desire to limit touchpoints when using a commercial laundromat. This may include limiting interaction with the user interface on the machines there, limiting the use of cash or coins, and avoiding high contact areas such as door handles or lids.

One aspect of this may be achieved by automating the act of opening and closing of the appliance door by the user. To avoid requiring the user to pull or push on the door, a hydraulic hinge system may be used to open and close the appliance door. The system may automatically open and close the door based on a user command. For example, the user may instruct the door to open via a mobile application on the user's phone. Additionally or alternatively, the user may provide instructions for a certain cycle or operation, and the door may open or close in conjunction with achieving the user's desired outcome (e.g., starting the wash cycle, completing the cycle, etc.). Other interface devices may also be used to receive a user input, such as a microphone to acquire audible commands or a gesture sensor to acquire gesture commands.

The hydraulic system may include a hydraulic cylinder configured to apply force on the door. The cylinder may be arranged within the door frame on a front panel of the appliance, and may apply force to the outer door frame of the door. The cylinder may also apply a reverse force or pulling force on the door to bring the door to a closed position. Oftentimes appliance doors require enhanced force to open and close due to certain industry requirements. The hydraulic system allows for the application of such force while being relatively inexpensive and durable as compared to other options.

Figure 1:
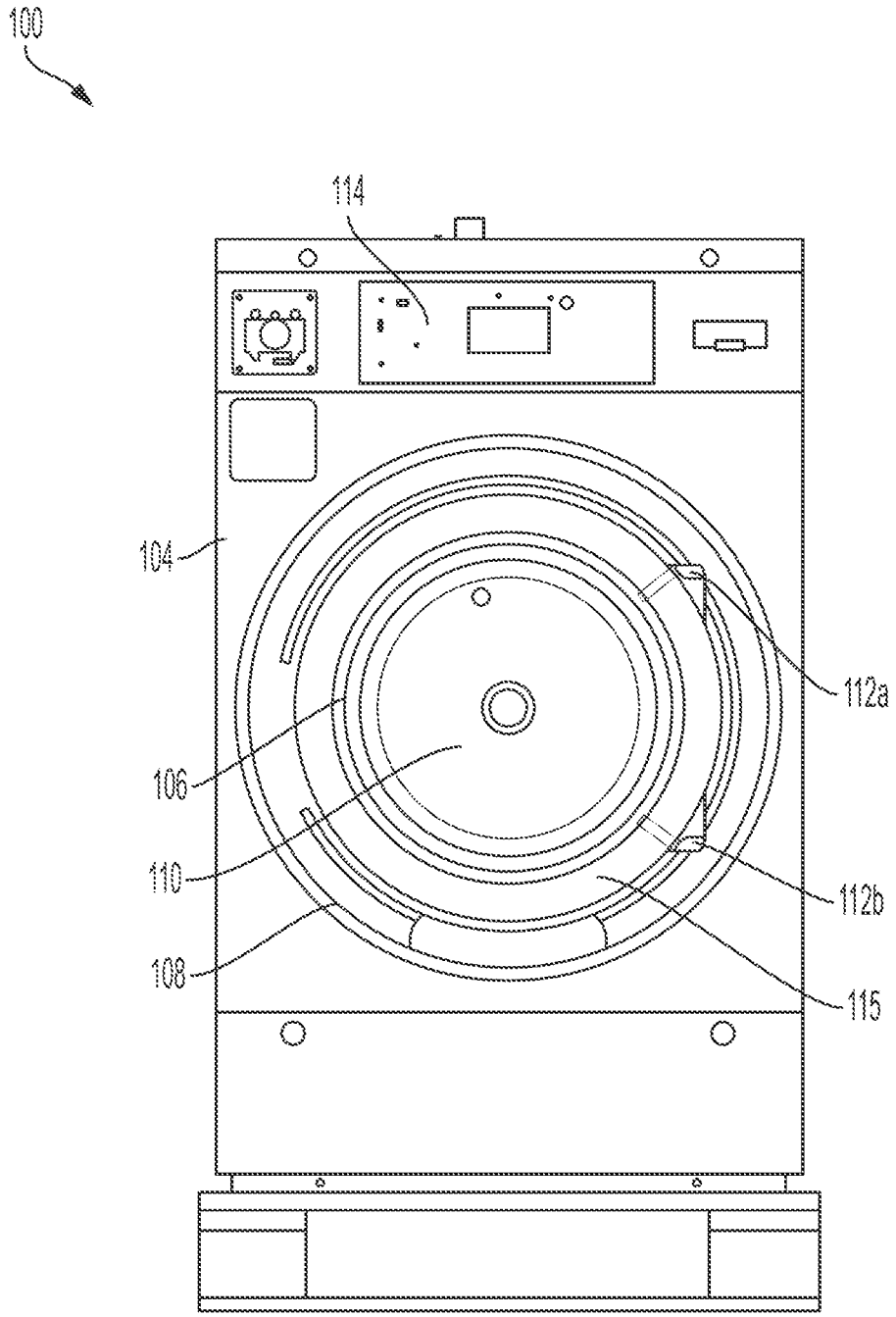
FIG. 1 illustrates a front elevational view of an appliance having a door in a closed position.
Figure 2:
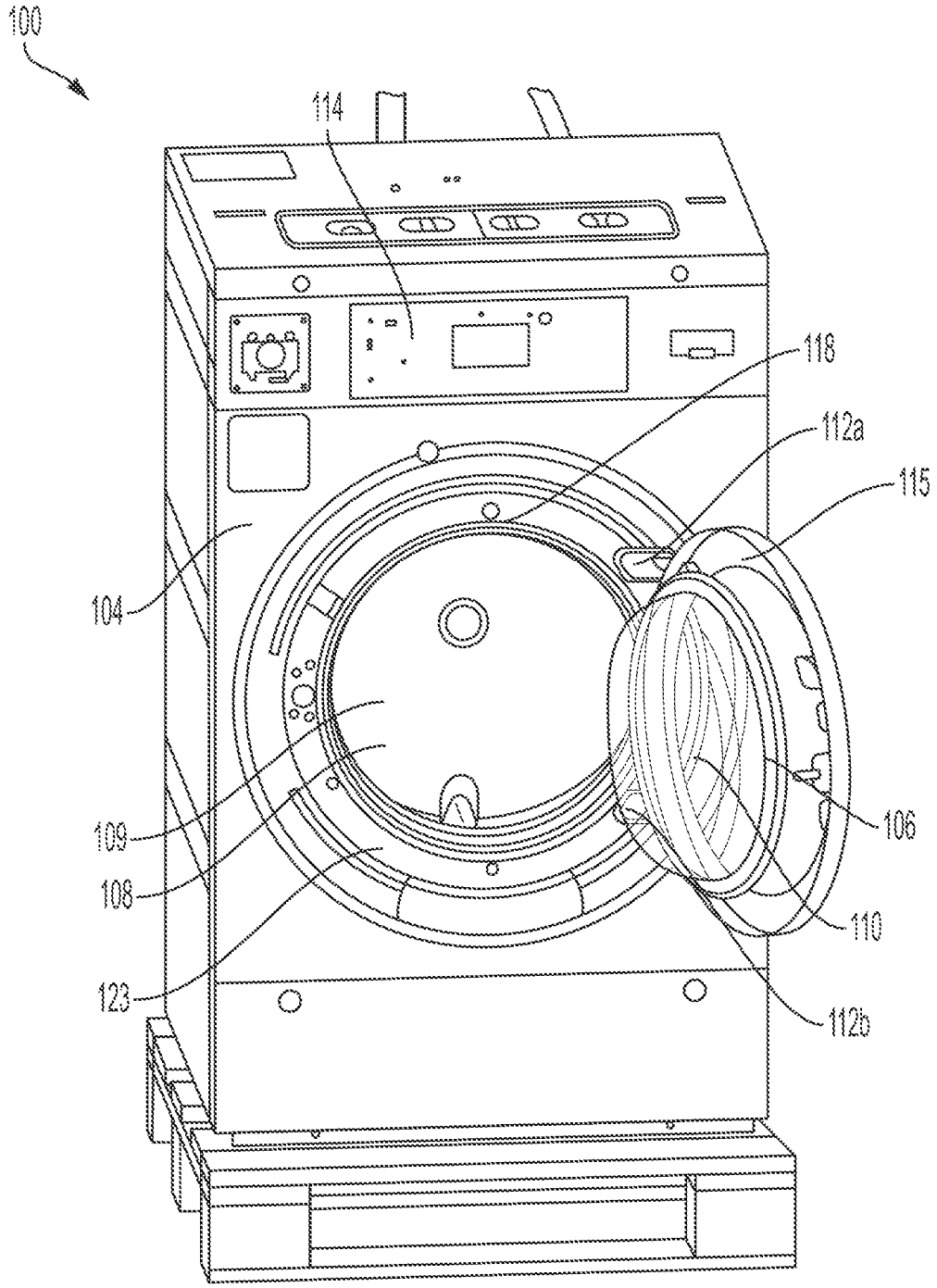
FIG. 2 illustrates a front perspective view of the appliance of FIG. 1 with the door in an open position.

FIG. 1 illustrates a front elevational view of a commercial appliance 100 having a door 106 in a closed position. FIG. 2 illustrates a front perspective view of the appliance 100 of FIG. 1 with the door 106 in an open position. The commercial appliance 100 may be a laundry appliance 100 such as a washer or dryer, configured to treat laundry, such as by washing and/or drying clothes and other textiles and items. While the appliance 100 may be referred to as a laundry appliance throughout, the appliance 100 may include other appliances such as dishwashers, ice makers, freezers, refrigerators, among others, that include doors or other closable openings.

The appliance 100 may include a cabinet having a front panel 104. The cabinet may house components typically found in a laundry appliance such as a laundry drum 109 (visible in FIG. 2) configured to receive laundry items, as well as a chassis, frame, motors, controls, fluid lines, sensors, vents, etc. The laundry drum 109 may be configured to receive laundry and rotate about an axis. In this example, the axis may be relatively horizontal. An access opening 108 may be defined in the front panel 104 to allow access to the drum 109. The access opening 108 may be selectively accessible via the door 106.

The door 106 may be attached to the front panel 104 about the access opening 108 via at least one hinge assembly 112. The hinge assembly 112 may include a pair of hinge assemblies 112, as shown in the example of FIGS. 1 and 2 as a first hinge assembly 112*a* and a second hinge assembly 112*b* and collectively referred to as hinge assembly or hinge assemblies 112. The hinge assemblies 112 may be spaced apart from one another along a vertical axis. In the example of a round or circular door, the hinge assemblies 112 may be placed at approximately 2 o'clock and 4 o'clock positions. In an example where the door is hinged on the opposite side, the hinge assemblies 112 may be placed at approximately 8 o'clock and 10 o'clock positions. More or fewer hinge assemblies 112 may be included. It is also conceivable that a hinge assembly 112 is arranged at the top or the bottom of the door 106. In other examples, the door 106 may be of another shape, such a square. In some examples, appliance 100 may be a vertical washing machine, with the door 106 located at the top of the appliance 100 for the loading of laundry units.

The door 106 may rotate or hinge about the hinge assembly 112 between the open and closed positions. A latch may be arranged at or near the access opening 108 to latch the door in a closed position. The latch may be arranged on an opposite side of the door than the hinge assembly 112. The hinge assembly may be capable of disengaging the door from the latch in order to open the door, as well as engaging the latch with the door upon closing the door. The hinge assembly 112 is discussed in greater detail in FIGS. 3 and 4 herein.

The door 106 may define a window 110 or a clear substrate to allow users to see inside the drum 109. The window 110 may be a bowl-like shape, or semi-circular shape, or the window 110 may be flat. Depending on the type of appliance 100, the window 110 may be formed of plastic, or in the example of the appliance being a dryer, the window may be glass. The door 106 includes a door frame 115 surrounding the window 110. The door may include various seals and gaskets, as well as other structural portions such as collars, flanges, plates, harnesses, screws, etc.

At the front panel 104, a panel door frame 123 surrounds the access opening 108 and is attached to the front panel 104. A gasket 118 may be arranged around the inside of the panel door frame 123 to create a hermetical seal against the door 106 when the door 106 is in a closed position. The hinge assembly 112 may be attached in part to both the front panel 104 and the panel door frame 123.

The appliance 100 may include a user interface 114 configured to receive commands from the user in order to operate the appliance 100. The user interface 114 may also include a display or speaker(s) in order to convey information to the user, such as cycle options, time remaining, etc. The user interface 114 may also include touch displays, cameras, microphones, gesture sensors, accelerometers, etc., to receive the user commands.

The appliance 100 may also include a controller for controlling certain cycles, components, etc. The controller may also be configured to control the hinge assembly 112. This is discussed in more detail below with respect to FIG. 5. In general, the controller instructs the hinge assembly 112 to open and close the door based on a command. The command may be in response to user input either at the user interface or a user device, such as a phone, tablet, etc. By allowing the user to issue a command to open and close the door remote from the commercial appliance, the user may avoid contact with the appliance 100, allowing for a contactless experience with traditionally high contact areas of the appliance 100 while laundering clothes.

Figure 3:
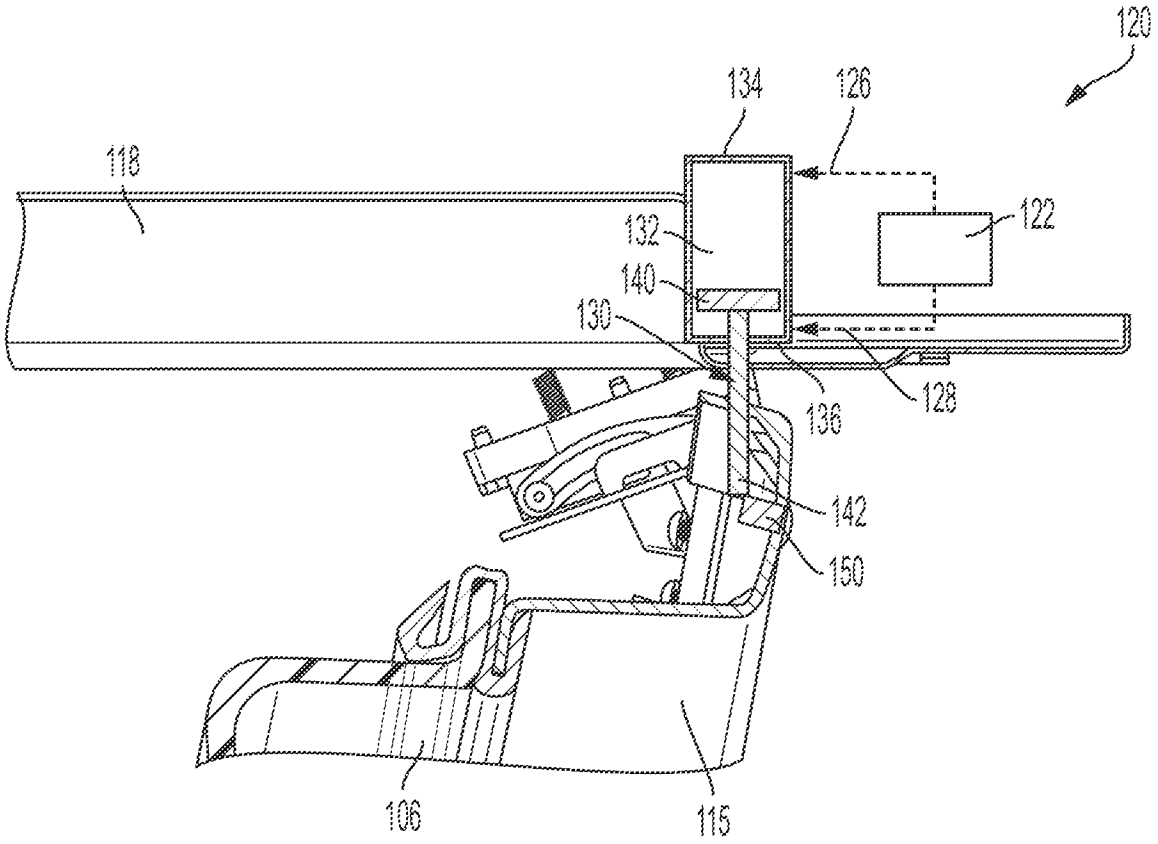
FIG. 3 illustrates a top cross-sectional view of a door hinge assembly of FIG. 1 with the door in the closed position.
Figure 4:
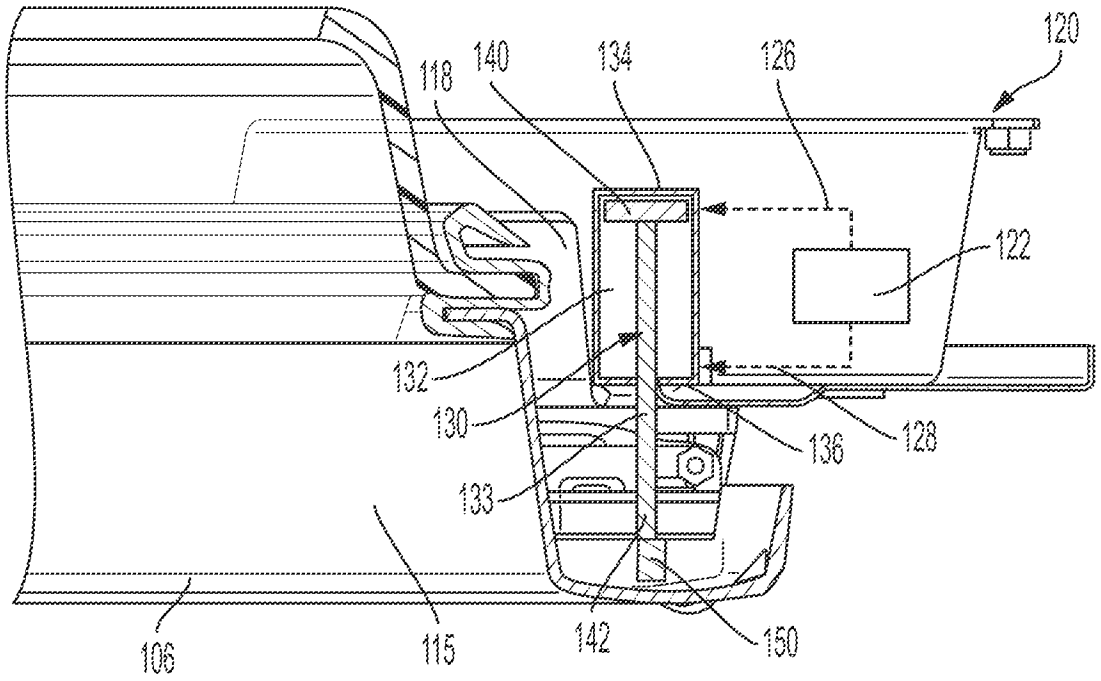
FIG. 4 illustrates a top cross-sectional view of a door hinge assembly of FIG. 2 with the door in the open position.

FIG. 3 illustrates a top cross-sectional view of the door hinge assembly 112 of FIG. 1 with the door 106 in the closed position. FIG. 4 illustrates a top cross-sectional view of the door hinge assembly 112 of FIG. 2 with the door 106 in the open position. The hinge assembly 112 may include a hydraulic assembly 120 configured to apply force to door frame 115 of the door 106. The hydraulic assembly 120 may be arranged at an inside of the front panel 104 within the cabinet. The hinge assembly 112 may be arranged at or near the access opening 108.

The hydraulic assembly 120 may include a hydraulic pump 122 having a first fluid line 126 and a second fluid line 128. A cylinder 132 housing a piston 130 may receive the two fluid lines 126, 128. The first fluid line 126 may be received at a first, distal end 134 while the second fluid line 128 may be received at a second, proximal end 136 of the cylinder 132. The hydraulic pump 122 may be configured to selectively pump fluid at each end of the cylinder 132 in order to actuate the piston 130 and adjust the position of the piston 130 within the cylinder 132. The fluid flow direction through one line is the opposite of the flow through the other.

The piston 130 includes a rod 133 having a base 140 and a rod end 142 at the opposite end of the rod 133. A portion of the rod 133 may extend out of the cylinder 132 at an opening defined by the proximal end 136. The rod end 142 may be configured to engage with at least one connecting hook 150 arranged on the door 106. The piston 130 may be configured to translate between a retracted position, as shown in FIG. 3, and an extended position, as shown in FIG. 4. In the retracted position, the base 140 of the piston 130 abuts the distal end 134. In the extended position the base 140 abuts the proximal end 136. In the extended position the piston 130 applies force at the hook 150, forcing the door 106 to open, as shown in FIG. 4. To close the door, the piston 130 may pull the hook towards the front panel 104.

The position of the piston 130 and thus the position of the rod end 142 may be controlled by the hydraulics of the hydraulic pump 122. By opening the first fluid line 126, fluid may push the base 140 of the piston 130 toward the proximal end 136 of the cylinder 132. By opening the second fluid line 128, fluid may push the base 140 of the piston 130 toward the distal end 134 of the cylinder 132. The hydraulic assembly 120 may interface and be controlled by the controller.

The hook 150 may include a hook-like mechanism attached to the door 106 at a hinge point. The hook may be pivotable or rotatable with respect to the rod end 142 in order to accommodate the varying position of the end. That is, the hook 150 may hinge or move to accommodate the position of the door relative to the piston 130. For example, the hook 150 may be a chain, ball-joint, universal joint, linkage mechanism, etc. The hook 150 may be movable with respect to the piston 130 but also fixed at the rod end 142 in order to accept the force applied by the end, whether it be a push force to open the door 106 or a pull force to close the door 106.

Figure 5:
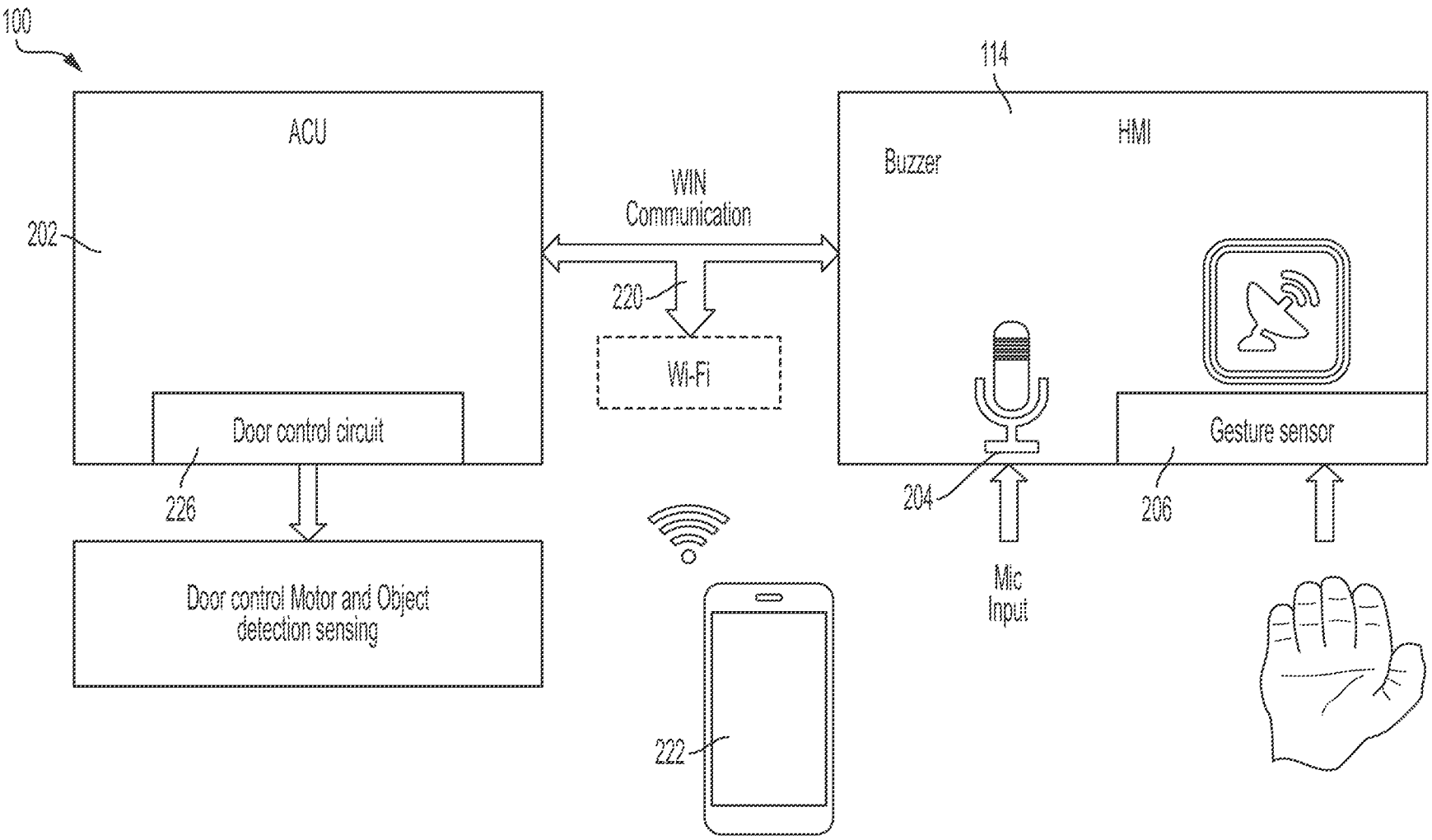
FIG. 5 illustrates an example appliance system for contactless operation of the appliance door.

FIG. 5 illustrates an example appliance system 200 for contactless operation of the appliance door 106. The appliance 100 may include a controller 202 and the user interface 114. The user interface 114 may include various devices configured to receive user input such as a microphone 204 and a gesture sensor 206. The microphone 204 may be configured to receive audible commands from the user, while the gesture sensor 206 may be configured to detect motion and receive gestures from the user.

Each audible or gesture command may indicate that the door is to open or close. For example, waiving a hand left to right may indicate to open the door 106, while an opposite movement of the hand from right to left indicates to close the door 106. Additionally, certain commands may infer a door status and command the door to actuate accordingly. For example, a verbal command of "start wash cycle" could infer that the door is to be closed.

The appliance 100 may include a wireless transceiver 220 configured to facilitate wireless communication between components within the appliance 100 as well as devices external to the appliance. The wireless transceiver 220 may be a BLUETOOTH module, a ZIGBEE transceiver, a Wi-Fi transceiver, an IrDA transceiver, a radio frequency identification (RFID) transceiver, near field communication (NFC), etc. The wireless transceiver 220 may be configured to communicate with a compatible external device, such as a mobile device 222. The mobile device 222 may include a mobile application for receiving user commands for operation of the appliance 100. These commands may be transmitted to the controller 202 and the appliance 100 may be operated accordingly. The user command may also include payment authentication, user authentication, and other forms of commands that may be necessary prior to initiating a load of laundry.

The controller 202 may interface with a door control circuit 226 which may instruct the hydraulic assembly 120 to operating the first and second fluid lines 126, 128 according to the user commands. For example, the user may issue a command by moving his or her hand in front of the gesture sensor 206. The controller 202 may interpret this command as being one to open the door 106. The controller 202 may then, via the door control circuit 226, instruct the hydraulic assembly to open the first fluid line 126. The fluid within the first fluid line 126 may push the piston 130 into the extended position, applying force on the hook 150. The force on the hook 150 may then cause the door 106 to open.

In another example, the user may complete loading his or her items into the drum 109. On the mobile device 222, the user may select a cycle and associated options for the laundry load. Upon confirming the selection, the information may be transmitted to the controller 202 of the appliance. The controller 202 may in turn verify that the door is not closed, and transmit instructions to the hydraulic assembly to open the second fluid line 128. This may in turn allow the piston 130 to move back into the cylinder 132, creating a pulling force on the hook 150 to close the door 106.

The force of the hydraulics in the hinge assembly 112 may actuate the door 106 so that the door 106 may open and close without additional force needed from the user, allowing for contactless operation at the appliance 100.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a read-only memory (ROM), an erasable programmable read-only memory (EPROM) or Flash memory, an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

The flowcharts and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A contactless laundry treating apparatus, comprising:

a cabinet having a front panel defining an access opening configured to receive laundry items; and a door attached to the front panel via a hinge assembly, the hinge assembly including a hydraulic system arranged on an interior of the front panel within the cabinet configured to engage with a connecting hook arranged within the door to selectively apply an outward force on the connecting hook to open the door and an inward force on the connecting hook to close the door, wherein the hydraulic system includes a piston and the connecting hook is fixed to the piston via a universal joint.

2. The apparatus of claim 1, wherein the connecting hook is movably fixed to the piston.

3. The apparatus of claim 1, wherein the hydraulic system includes a first fluid line and a second fluid line, each configured to control a position of the piston.

4. The apparatus of claim 2, wherein the hydraulic system is configured to open the first fluid line to extend the piston and apply the outward force on the connecting hook to open the door.

5. The apparatus of claim 3, wherein the hydraulic system is configured to open the second fluid line to retract the piston and apply the inward force on the connecting hook to close the door.

6. A door assembly for a commercial laundry treating apparatus, comprising:

a door attached to a front panel of an appliance via a hinge assembly to allow selective access to an interior of the appliance; and a connecting hook arranged on the door at the hinge assembly, the hinge assembly including a hydraulic system at least partially arranged on an interior of the front panel, the hydraulic system including a hydraulically driven piston attached to the connecting hook, the piston configured to selectively apply an outward force on the connecting hook to open the door and an inward force on the connecting hook to close the door, wherein the hook is rotatably fixed to the piston via a ball joint.

7. The apparatus of claim 6, wherein the hydraulic system includes a first fluid line and a second fluid line, each configured to control a position of the piston.

8. The apparatus of claim 7, wherein the hydraulic system is configured to open the first fluid line to extend the piston and apply the outward force on the connecting hook to open the door.

9. The apparatus of claim 8, wherein the hydraulic system is configured to open the second fluid line to retract the piston and apply the inward force on the connecting hook to close the door.

10. A method for automating interaction with high contact appliance areas, comprising:

applying an outward force on a connecting hook to open a door to a treatment chamber of an appliance, by pumping liquid from a first side of a piston to a second side of the piston, thereby extending a rod connecting the piston to the connecting hook outward from the appliance; and applying an inward force on the connecting hook to close the door to the treatment chamber of the appliance by pumping the liquid from the second side of the piston to the first side of the piston, thereby retracting the rod inward into the appliance, wherein the connecting hook is rotatable fixed to the piston via a ball joint.

11. The method of claim 10, wherein the applying an outward force includes opening a first fluid line at the first side.

12. The method of claim 10, wherein the applying the inward force includes opening a second fluid line at the second side.

* * * * *